United States Patent [19]

Taylor

[11] Patent Number: 4,765,067

[45] Date of Patent: Aug. 23, 1988

[54] STEAM-SHOWER APPARATUS AND METHOD OF USING SAME

[75] Inventor: Bruce F. Taylor, Auburn, Mass.

[73] Assignee: Thermo Electron - Web Systems, Inc., Auburn, Mass.

[21] Appl. No.: 42,911

[22] Filed: Apr. 27, 1987

Related U.S. Application Data

[63] Continuation-in-part of Ser. No. 834,957, Feb. 28, 1986, Pat. No. 4,685,221.

[51] Int. Cl.[4] ..... F26B 13/02

[52] U.S. Cl. ..... 34/23; 34/54; 34/155; 34/160; 162/207

[58] Field of Search ..... 34/155, 160, 156, 54; 162/207, 389, 290; 239/DIG. 7

[56] References Cited

U.S. PATENT DOCUMENTS 4,271,602 6/1981 Grolms ..... 34/160

4,685,221 8/1987 Taylor et al. ..... 34/155

*Primary Examiner*—Larry I. Schwartz

*Attorney, Agent, or Firm*—Lorusso & Loud

[57] ABSTRACT

Disclosed is a steam-shower apparatus and method including a supply of steam which is fed through a Coanda nozzle and along a path running adjacent one surface of the apparatus which is heated to a temperature in excess of 212 degrees Fahrenheit. The sheet to which the steam is to be applied runs adjacent this same surface of the machine, but in a direction opposite to the direction of the flow of steam. In one embodiment, the heated surface is located relative to the sheet so that an upstream edge of the apparatus is spaced from said sheet by a greater distance than is the downstream edge of the apparatus which preferably contacts the sheet to back pressure the steam between the apparatus and sheet. The flow of steam runs the entire length of this surface heating the sheet as it flows in the opposite direction. The apparatus may be divided into several sections so that the sheet may be profiled along certain regions which are defined by these sections. In addition, means are included for altering the volume of flow to any one of the particular sections. To create these sections a series of ridges extend from the heated surface.

30 Claims, 5 Drawing Sheets

STEAM-SHOWER APPARATUS AND METHOD OF USING SAME

CROSS REFERENCE TO RELATED APPLICATION

This application is a continuation-in-part application of U.S. application Ser. No. 834,957 which was filed on Feb. 28, 1986 now U.S. Pat. No. 4,685,221.

BACKGROUND OF THE INVENTION

This invention relates to papermaking and more particularly to an apparatus for controlling the temperature of a web or sheet of paper through the controlled application of steam against the sheet surface.

In the mechanical pressing of paper the drainage rate is proportional to the viscosity and surface tension of the trapped water. The increasing of sheet temperature decreases the water viscosity and surface tension, hence augmenting the pressing process. As shown in U.S. Pat. Nos. 3,574,338; 3,945,570; 4,050,630 and 4,163,688, it is common practice to apply steam to a sheet immediately prior to the sheet entering the press so that the latent heat of the steam heats the sheet.

The press is located before the dryer section of a paper-machine. Therefore, increasing the water removal rate through the press serves to decrease the sheet moisture content of a sheet entering the dryer-section, thereby either reducing the energy consumption required to further dry the sheet or increasing production (speed) at constant dryer section energy consumption.

The controlled application of steam at equally spaced increments across the machine can be employed to control the initial and hence final moisture profile of the sheet. At the dry end of the machine, following the dryer-section, the sheet is passed through a vertical column of horizontal-axis rolls known as a calender-stack. The surface finish and thickness or caliper of the sheet is directly affected by both the contact pressure between two adjacent rolls of the stack through which the sheet passes and the compressibility and shear modulus of the sheet, which are proportional to the moisture and temperature profile of the sheet (although not exclusively). Applying steam to the sheet using "steam-showers" will affect both the moisture and temperature of the sheet, and hence, the caliper and surface finish qualities (such as gloss) of the sheet. Applying a uniform amount of steam across the machine can thus decrease the caliper of the sheet leaving the calender stack and increase the gloss of the final product. Applying controlled amounts of steam at selected positions across the machine can thus be used, by extension, to control the caliper and/or gloss profile of the final product.

In any steam application, the effective usage of the consumed steam should be maximized. To maximize the effective usage, the percentage of consumed steam that condenses on the sheet for the purpose of raising the sheet temperature should be maximized, and the percentage of consumed steam that does not condense which exhausts to the atmosphere as wasted energy should be minimized.

There are certain applications where the steam application does not have to be positionally and volumetrically controlled. In other applications, however, it is necessary to impart steam to the process in controlled amounts at specified positions across the machine for profiling certain sheet qualities. This controlled imparting of steam is commonly performed as part of a closed-loop control system, where the sheet quality variable in question is scanned on-line at equally spaced increments across the machine, and the results obtained by the scanning device, through the use of computer analysis, are used to automatically control the steam-flow applied to the sheet in accordance with the desired sheet quality criteria.

The ability of known steam-shower apparatus to repeatedly apply a uniform steam flow is presently limited to the accuracy and repeatability of pneumatically actuated control valves, whose pneumatic-supply signal must first be converted from a computer level electric signal to a pneumatic counterpart using a current to pressure transducer, the combined accuracy and repeatability of which is questionable.

For the same reasons that it is important to control accurately the steam-flow to the application, it is also important to maintain uniform heat-transfer, over the portion of the sheet in question.

It is therefore a principal object of the present invention to provide a steam-shower apparatus which maximizes the percentage of consumed steam that condenses on the sheet.

Another object of the present invention is to provide a steam-shower apparatus that makes maximum usage of generated steam and efficiently utilizes the energy required for generating steam.

A further object of the present invention is to provide a steam-shower apparatus which applies steam in such a way that the entrainment of non-condensable air into the condensation space, which severly hampers condensation heat transfer, is limited or eliminated.

It is another object of the present invention to provide a steam-shower apparatus which insures that the high initial relative velocities between the steam and the sheet, as required to provide effective heat transfer, are maintained over the full machine-direction length of the application apparatus.

Still another object of the present invention is to provide a steam-shower apparatus which insures that the steam-flow is made to travel over the full length of the steam application apparatus so that the time of contact between each volumetric unit of steam and the sheet is maximized.

Yet another object of the present invention is to provide a steam-shower apparatus that accurately and repeatably applies steam to a sheet at any required position across the machine.

Another object of the present invention is to provide a steam-shower apparatus that allows for improved accuracy and repeatability of steam-flow control.

Still another object of the present invention is to provide a steam-shower apparatus that applies steam to a sheet in such a way that uniformity of heat-transfer is provided in the cross-machine direction.

A further object of the present invention is to provide a steam-shower apparatus that applies the steam in such a way that the steam does not impinge on the sheet directly out of the nozzle.

SUMMARY OF THE INVENTION

According to the present invention, a steam-shower apparatus is provided for use in controlling the temperature of a sheet by applying steam against the surface of the sheet. The apparatus includes a steam supply manifold which supplies steam through a feed pipe to a chamber leading to a Coanda nozzle. The Coanda nozzle is arranged in the apparatus so that the steam flowing through the Coanda nozzle is directed along a surface of the apparatus which is positioned adjacent and parallel to the sheet which is to be heated. The steam flows in a direction opposite to the direction of travel of the sheet so that a high relative velocity vector for the steam flow is achieved over the full distance of the steam-to-sheet contact. The apparatus includes a secondary chamber for receiving a sacrificial flow of steam which is entrained by the flow of steam exiting the Coanda nozzle.

In a preferred embodiment, the Coanda chamber and corresponding Coanda nozzle is divided in several Coanda chambers and associated nozzles by positioning baffles around several feed pipes which are arranged across the width of the machine. Each of the feed pipes is connected to a stepper motor which is coupled to a valve poppet which opens and closes an orifice in the feed pipe to either totally close the orifice to prevent steam from entering the feedpipe or to partially close the orifice to thereby adjust the volume of steam entering the feedpipe. This orifice control device allows for application of steam to be used in profiling operations.

In another preferred embodiment, the steam supply manifold is located in the lower portion of the apparatus so that the bottom wall of the apparatus is also the bottom wall of the steam supply manifold. In still another embodiment, the apparatus is mounted above the travelling sheet so that a downsteam corner of the apparatus contacts the web so that steam is back pressured between the sheet and the apparatus. In order to apply steam to the web in a profiled fashion, a plate with extending ribs is mounted to an underside of the apparatus so that the ribs contact the sheet travelling through the apparatus over the full length of the apparatus.

These and other features and objects of the present invention will be more fully understood from the following detailed description which should be read in conjunction with the several figures in which corresponding reference numerals refer to corresponding parts throughout the several views.

DETAILED DESCRIPTION OF THE PREFERRED EMBODIMENTS

Figure 1:
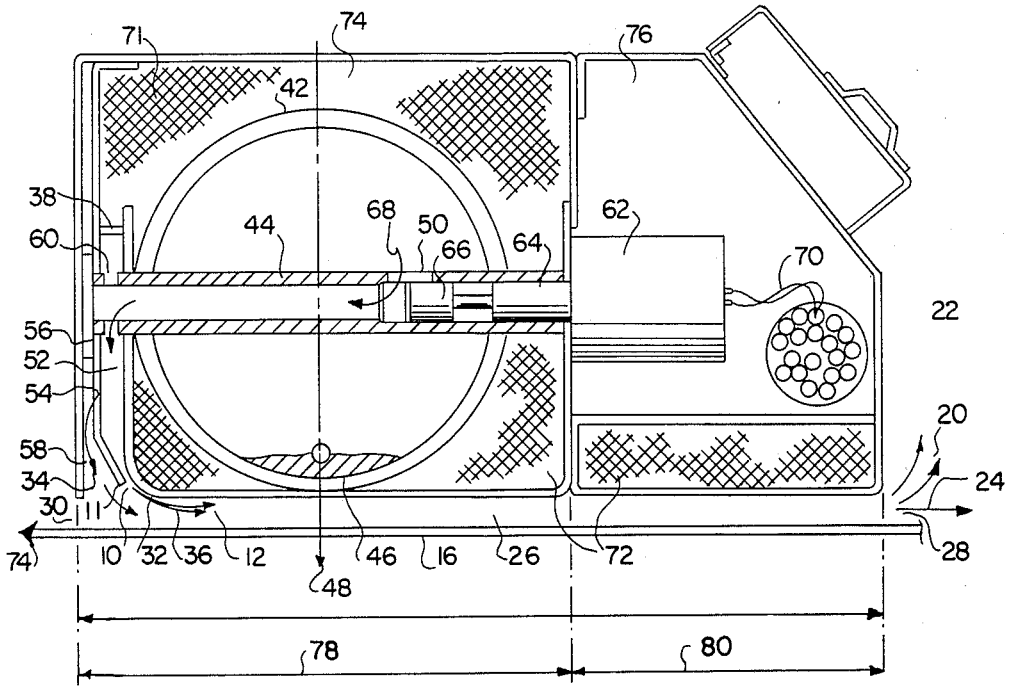
FIG. 1 is a sectional-view of a steam-shower apparatus of the present invention, positioned adjacent the sheet, employing positional steam-flow control.

Referring to FIG. 1, the steam-shower apparatus for applying steam to a web or sheet, hereafter referred to as a "steam-foil", includes an air-foil type nozzle 10, utilizing the Coanda effect, to impart steam in a direction 12 roughly parallel but opposite in direction to the direction 14 of travel of the sheet 16. This Coanda effect steam foil prevents the direct impingement of steam on the sheet, so that the steam-foil may be installed directly above or below an unsupported sheet 16 without inflicting mechanical damage to the sheet. In addition, water droplets in the steam are conveyed parallel to the sheet for a distance greater than the distance water droplets are conveyed with an impingement-type steam shower, thereby aiding in the process of droplet dispersion and re-vaporization. Such droplet dispersion and re-vaporization is useful in minimizing "spotting" of the sheet. Unlike an impingement-type steam shower where the flow vector stagnates against the sheet, or a "lazy-steam" hood applicator where the relative velocity vector important for heat-transfer is not maintained, the parallel counter-flow principal of the invention insures the continuance of a high relative velocity vector over the full distance 18 of steam-to-sheet contact.

By locating the Coanda nozzle exit slot 11 at the downstream edge of the steam-foil, steam is forced to travel over the full length 18 (machine-direction) of the steam-foil before non-condensed steam 20 may exhaust to the atmosphere 22. In comparison, in known impingement-type steam showers which impart steam to the sheet through either a full-coverage array of holes or slots or a raised hood into which steam is supplied for full-coverage application, only that steam applied at the upstream edge is exposed to the sheet for the full duration of the sheet-travel under the apparatus (as the moving sheet typically carries the upstream steam with it for exhausing at the downstream edge). The duration of steam contact with a sheet for other steam-shower units is proportionately decreased by the distance of the point of application from the upstream edge (the extreme case being those units of steam applied close to the downstream edge whose duration of contact with the sheet is negligible).

An additional feature of the invention is that the high velocity counter-flow running parallel to the sheet insures that even after exhausting at the upstream edge, a significant percentage of the non-condensed steam 24 continues to flow roughly parallel to the sheet for a considerable distance, effectively preheating the sheet before it actually enters the apparatus. This non-condensed steam 24 thereby serves to effectively utilize some of the exhaust steam which would otherwise be wasted.

In the interest of limiting the entrainment of noncondensible air into the condensing-space 26 located between the apparatus and the sheet 16, the counter parallel-flow nature of the system insures that the exhausting steam creates a positive pressure "wall" at the incoming or downstream edge 28 of the apparatus, thereby decreasing the volume of air which can be entrained by the moving sheet 16. At the outgoing or upstream edge 30 of the apparatus, the velocity of the sheet serves to limit the volume of air entering the condensing space, close to the surface of the exiting sheet. Typically, a Coanda nozzle 10 will entrain, from its ambient surroundings, a volume of fluid (on a mass basis) required to offset the angular momentum or centripetal forces created by the curved path of travel of the nozzle fluids around the Coanda nozzle surface 32. To limit or eliminate the entrainment from close to, and behind the Coanda nozzle, a sacrificial flow of steam 34 (approximately 10 to 30% of the nozzle flow) is supplied at low velocity normal to the sheet 16, behind the nozzle 10. The sacrificial steam-flow 34 is intended to be entrained by the nozzle flow 36, rather than air outside the apparatus, which would be detrimental to the heat-transfer performance of the apparatus.

Figure 2:
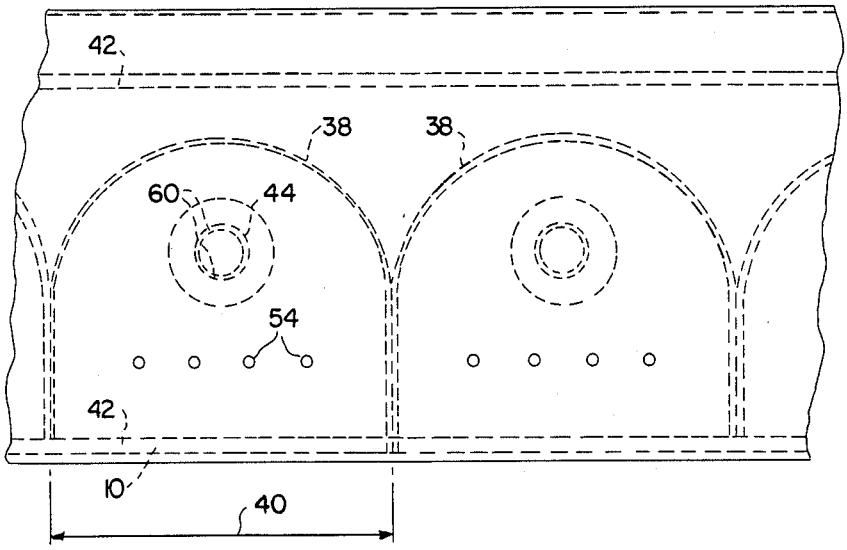
FIG. 2 is a front elevational view of a segment of the steam-shower apparatus shown in FIG. 1.

Referring now to FIG. 2 as well as FIG. 1, the design of the Coanda nozzle 10 and the internal baffling required on a unit employed for the variable control of positional and volumetric steam-flow, hereafter referred to as the profiling embodiment of the invention, is such that steam exits the nozzle to be used in the process described above through a uniform slot 11, thereby insuring uniformity of steam-flow and heat-transfer in the cross-machine direction at the desired positional location 40.

Steam is supplied to the apparatus and conveyed across the machine width by an oversized distribution header 42 (typically having a six inch diameter) to insure uniform supply distribution across the machine. At equal spacings across the machine, feed-pipes 44 (typically having a one inch diameter) located horizontally and normal to the axis of the supply manifold 42 traverse the diameter of the supply manifold 42.

Any undesirable condensation in the supply manifold 42, being heavier than vapor, collects in the bottom 46 of the manifold 42 where it is bled to drain at the rear 48 of the apparatus. The removal of condensation from the manifold 42 insures that condensation in the nozzle exit-flow 14 is minimized.

An orifice 50 in the side of each feed-pipe 44 allows the steam to enter into the feed-pipe 44 from the supply manifold 42. The feed-pipe conveys the steam through two feed-pipe end-orifices 60 to a Coanda nozzle chamber 52. The steam exits the chamber 52 through the Coanda nozzle slot 11 from which it is applied to the sheet 16. Bleed holes 54 of a suitable diameter and spacing are located in the outboard wall 56 of the Coanda nozzle chamber 52. The specific diameter and spacing of the bleed holes 54 are chosen to provide the desired percentage of steam 34 to flow to a "sacrificial" steam chamber 58 to provide the sacrificial steam flow 34.

In the profiling embodiment of the invention, a direct-current stepping motor 62 is mounted on the outboard end of the feed-pipe 44. A lead-screw type coupling 64 connects the stepping motor shaft to a translating valve-poppet 66 located in the body of the feed-pipe 44 in the region of the inlet orifice 21.

Positioning of the stepping motor shaft angle translates the valve poppet 66 so as to increase or decrease the available open-area of the feed-pipe inlet orifice 50. As a result, the flow-rate of steam 68 through the feed-pipe inlet orifice 50 may be controlled, thereby enabling the controlled application of steam to the sheet.

The choice of a stepping-motor 62 as the preferred type of valve actuator is particularly important to the accuracy and repeatability of the control process. The small angular increments of shaft position (typically 2 degrees per step), combined with the turn-down ratio of the lead-screw coupling 64 combine to provide approximately 5000 precise and repeatable available valve-poppet 66 positions over a total valve-poppet travel of one inch. The specific values cited above may be changed in accordance with specific design requirements, but this example serves to indicate the extraordinary control definition, accuracy and repeatability available with such an actuator.

In addition to the above stated features, an attractive aspect of the stepping-motor actuator 62 is that it may be electrically coupled through actuating lines 70, directly to a computer control system so often used in profiling applications. Such coupling eliminates the need for any intermediate signal conversion (i.e., from electric to pneumatic), with an attendant presummed improvement in both control accuracy and repeatability.

The stepping-motor actuator 62, of course, may be replaced by any type of actuator which will operate a poppet-like device to provide the desired steam-flow control. In one embodiment, the stepping-motor actuator 62 is replaced by a manual valve comprising a threaded shaft which translates the valve-poppet 66, through the use of a fixed matching-threaded bushing in the region of the previously indicated lead-screw coupling 64. The outboard end of the threaded shaft includes, in the region of the previously indicated stepping-motor 62, a gripping-handle of suitable design to allow an operator to manually translate the valve-poppet 66 as required to manually vary the nozzle steam-flow 68.

To insure that steam originating from any specific control valve 50 is applied only to that portion 40 of the sheet that is colinear with the valve 50 and intended to be controlled, the Coanda chamber 52 is sectionally baffled with semi-circular baffles 38. The baffles 38 eliminate carry-over to adjacent nozzle locations. The "sacrificial" steam chamber 25 need not be baffled as it is reasoned that the low velocity of the "sacrificial" steam-flow 34, and the entrainment tendancy exhibited by the Coanda nozzle 10 will combine to insure that the "sacrificial" flow 34 is applied for use by the apparatus in the region 40 for which the application is intended.

The main body of the apparatus is insulated about the supply-manifold 42 with suitable insulation 72 to minimize the likelihood of condensation carry-over and to maximize the usage of the steam latent heat for the purpose intended.

As shown in FIG. 1, the apparatus includes two separate structural chambers, the manifold/nozzle chamber 74 (which in the preferred embodiment is of fixed standardized length 78) and the control chamber 76 (which in the preferred embodiment is of variable length 80). The variable length 80 may be chosen so as to provide the required apparatus length 18 required to aid in the attainment of the necessary steam condensing rate for each specific application. Alternatively, both lengths 78 and 80 may be chosen as fixed values, so as to provide a fixed apparatus length 18 deemed to be satisfactory for the attainment of successful performance over the full range of expected applications.

Figure 3:
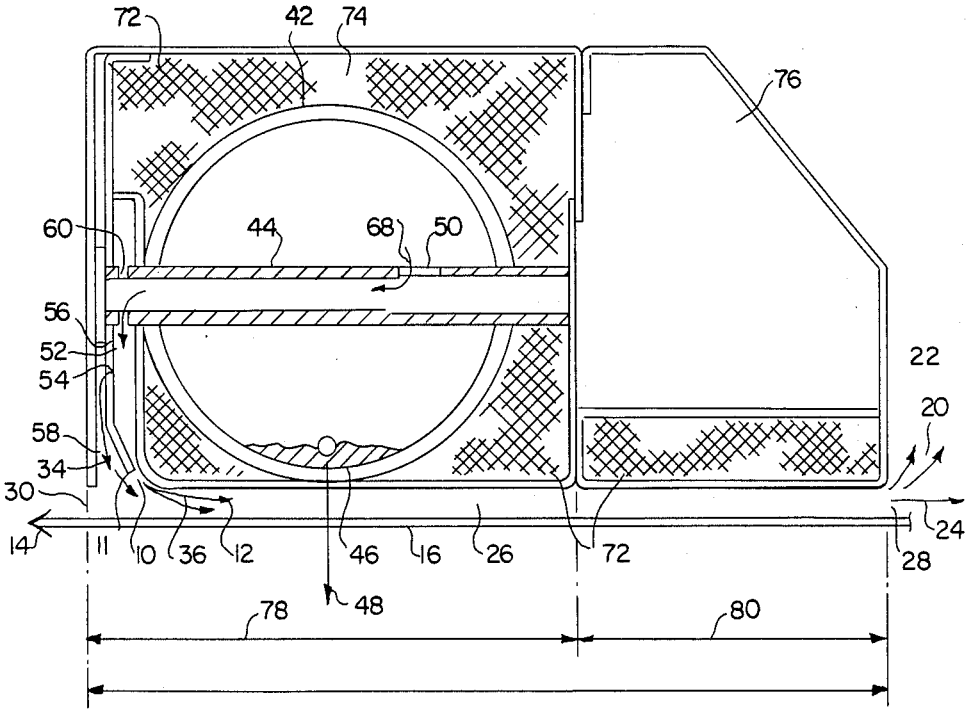
FIG. 3 is a sectional view of an alternate embodiment of the steam-shower apparatus shown in FIG. 1, positioned adjacent to the sheet, employing a uniform cross-machine steam-flow.

Referring to FIG. 3, an alternate embodiment of the present invention is shown in which the apparatus is not segmented, and a uniform application of steam across the full width of the sheet is provided. In view of the fact that the profiling operations described above with respect to the FIG. 1 embodiment are not necessary, the apparatus of FIG. 3 does not include the stepping-motors 62, valve-poppets 66, and the Coanda nozzle baffles 38. The remaining components of the apparatus are identical to the apparatus shown in FIG. 1, and operation is identical to operation of the FIG. 1 embodiment with each orifice 50 of the apparatus completely open.

Figure 5:
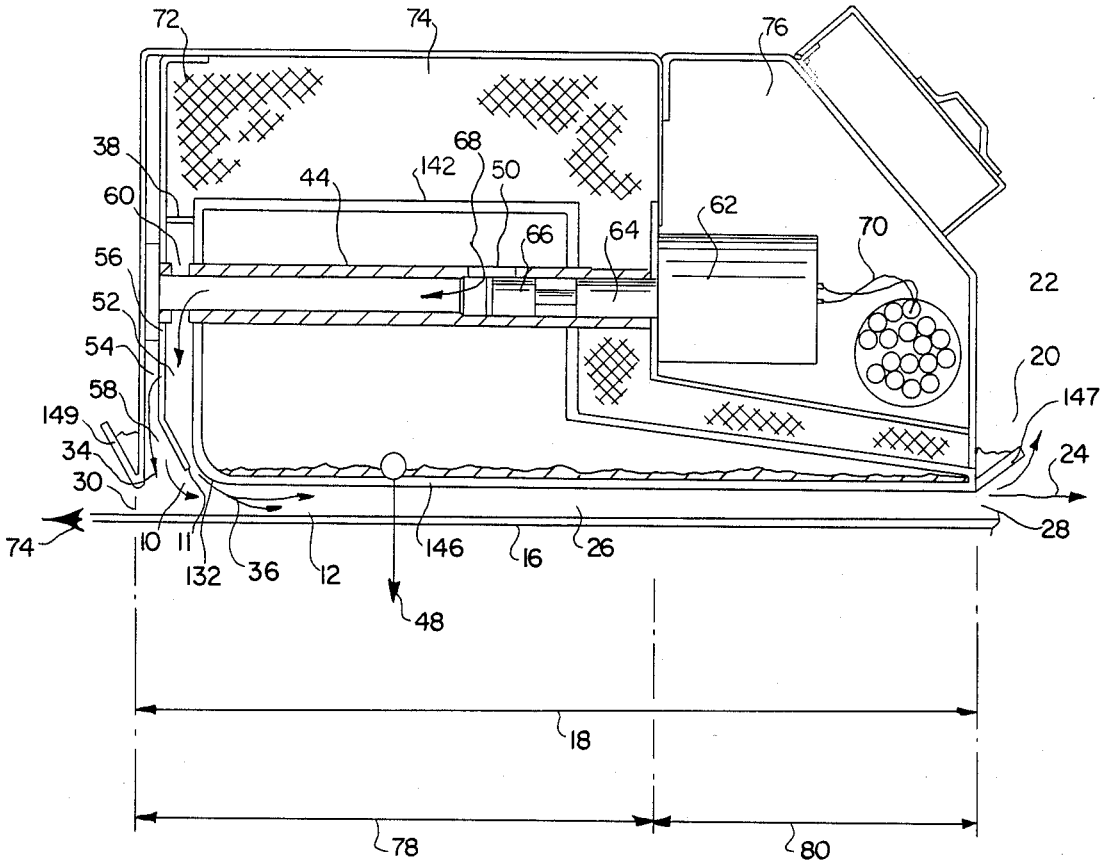
FIG. 5 is a sectional view of a further alternate embodiment of the steam shower apparatus shown if FIG. 1 in which the steam supply manifold forms the bottom portion of the apparatus.

In certain applications, it is important that no moisture other than that resulting from film condensation at the steam-sheet interface is deposited on a sheet 16 travelling through the apparatus. Under certain conditions in the embodiments described above, moisture condenses on the bottom surface 46 of the apparatus and eventually drips onto the sheet 16. The embodiment of the steam-shower apparatus shown in FIG. 5 eliminates this condensation. In FIG. 5, the steam supply manifold 142 is configured so that the steam supply manifold 142 constitutes the entire bottom surface 146 of the apparatus. The corner 132 of the supply manifold 142 at the upstream edge of the apparatus is also curved so as to form the curved surface of the Coanda nozzle 10. Steam within the steam supply header is either at a sufficient pressure (approximately 5–15 psig) or at a sufficient superheat temperature to insure that the temperature of the outside bottom surface 146 is above 212 degrees Fahrenheit. By maintaining the surface temperature of surface 146 above 212 degrees Fahrenheit, no discharged steam condenses on the outside bottom surface 146, because the surface is too hot for any condensation to occur at atmospheric conditions. As a result, there is no dripping of moisture onto the sheet.

Steam can also escape from the downstream side 28 of the apparatus because the sheet may carry steam as it exits the apparatus. Steam can also leak out at the upstream side 30 of the apparatus. The escaping steam then tends to condense on the outside walls of the apparatus which are much cooler than bottom surface 146. This condensed steam then drips on the sheet and may result in sheet irregularities. To prevent this dripping, drip shields 147, 149 are positioned at the downstream 28 and upstream 30 edges of the apparatus respectively. Shield 147 is an extension of the bottom surface 146 so that the temperature of this shield is approximately the same as the bottom surface 146. As a result any steam striking this shield will be vaporized by the shield, and any other steam that passes around the shield and condenses on the apparatus will fall into the pocket created between the shield and the apparatus. This collected water may then be drained away. The shield 149 extends from the outside wall of the sacrificial chamber 58 and operates in the same fashion as shield 147. If a sacrificial chamber 58 is not used, the shield 149 extends from the outside wall of the Coanda nozzle 10.

Figure 6:
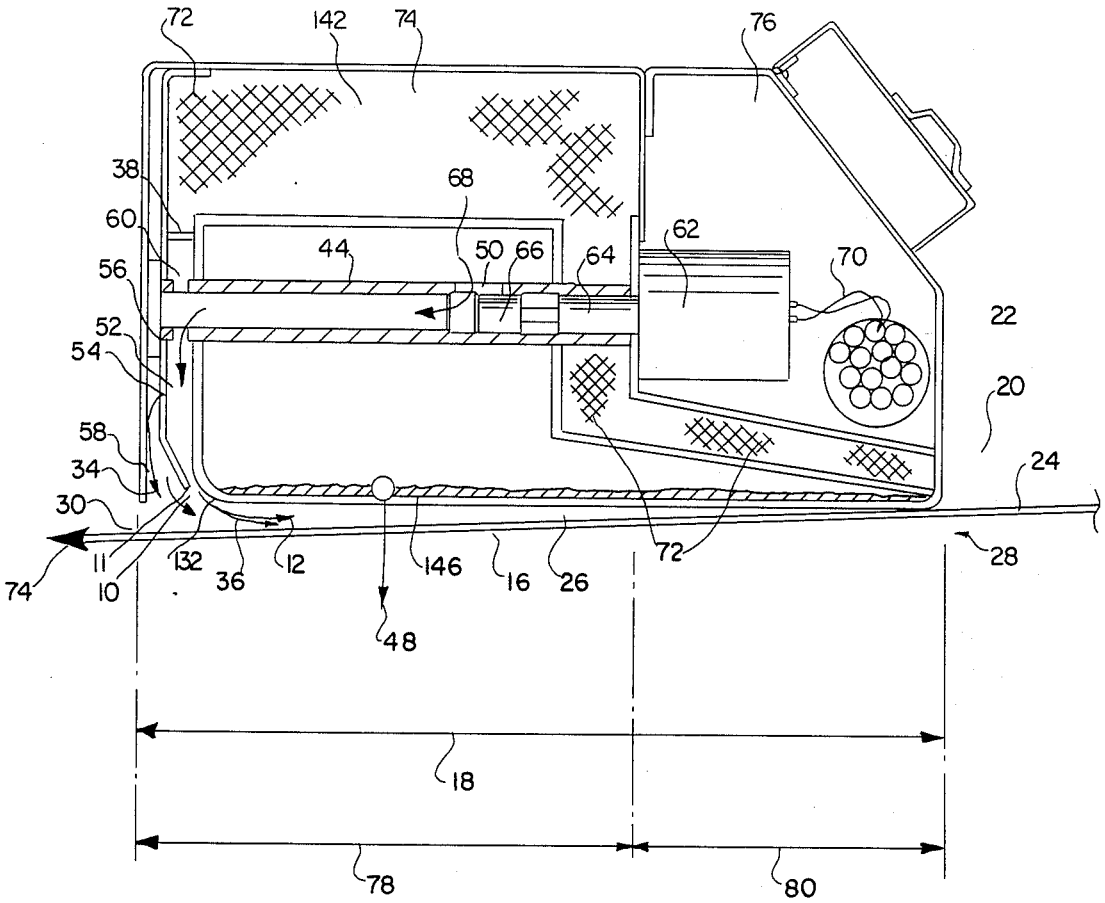
FIG. 6 is a sectional view of an additional embodiment of the steam-shower apparatus shown in FIG. 5.
Figure 7:
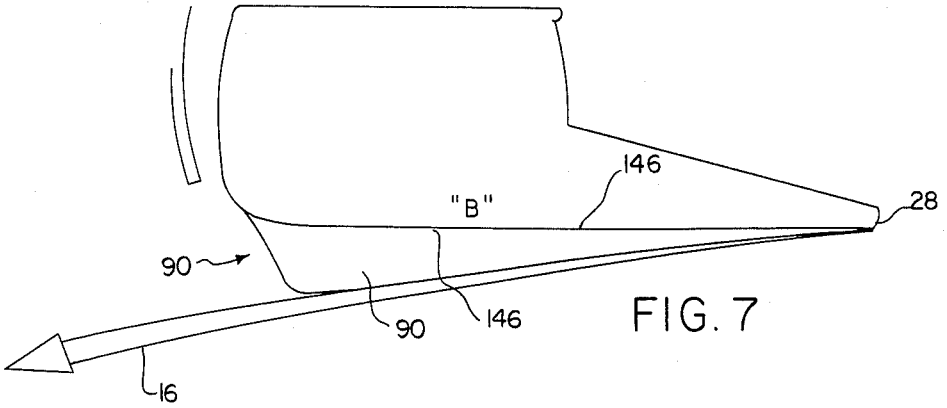
FIG. 7 is a simplified plan view of another embodiment of the steam-shower apparatus shown in FIG. 6 with only the steam supply manifold of the apparatus being shown.
Figure 8:
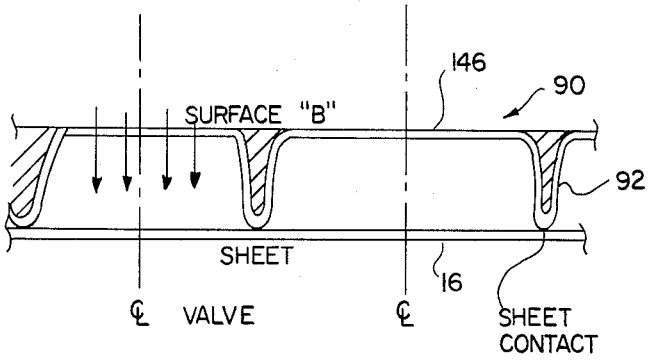
FIG. 8 is a perspective view of the profiling plate attached to the apparatus shown in FIG. 7.
Figure 9:
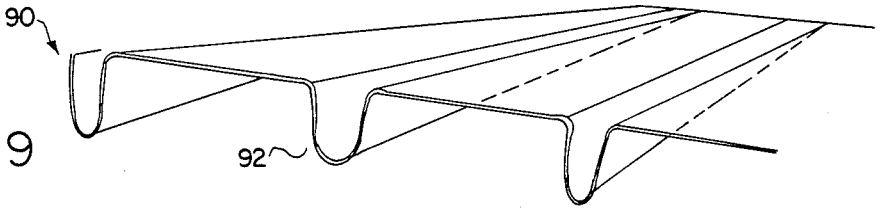
FIG. 9 is a front elevational view of the profiling plate shown in FIG. 8.

In order to further reduce any possible condensation on the bottom surface 146 of the apparatus and therefore eliminate dripping onto the sheet, the apparatus, as shown in FIG. 6, is angled relative to the plane over which the sheet 16 travels so that the apparatus and the sheet contact each other or are brought to within a few millimeters of each other at the downstream edge 28 of the apparatus. This configuration can only be used on a formed sheet which can sustain contact without damage. The angling of the housing and sheet results in the backpressuring of the steam and the physical elimination of any air entrainment introduced by the sheet movement thereby increasing the heat transfer rate of the apparatus. Backpressuring of the steam will create a pressure pad which may augment the condensing heat transfer rate. This arrangement also reduces or eliminates the exhausting of uncondensed steam from the downstream edge of the apparatus thereby reducing the possibility of condensation on surrounding machine components which results in dripping and other related sheet property problems. In this embodiment, as in the embodiment of FIG. 5, the steam supply manifold 142 is shaped to form the lower portion of the apparatus.

In order to obtain a fine degree of profiling and still utilize the features of the embodiments of FIGS. 5 and 6, a corrugated profiling plate 90 is attached to the bottom surface 146 of the apparatus. This plate 90 has a series of ridges 92 which contact the sheet along the entire length of the plate as the sheet 16 travels through the apparatus. This profiling plate 90 can only be used on a formed sheet which can sustain contact without damage.

The ridges 92 extending from the plate 90 attached to the apparatus are angled so that their height is greater at the upstream edge of the apparatus than at the downstream edge 28 of the apparatus. The ridges 90 should also be enclosed at their upstream ends so that steam does not pass between the surfaces making up the ridges. While the profiling mechanisms including the stepping-motor 62, coupling 64 and valve-poppet 66 do, to a certain extent, locally control the application of steam to the sheet, this control is not suitable for some applications requiring very precise control, and when the steam is also backpressured localized distribution of the steam is even more difficult to control. When the profiling plate 90 is attached to the shower and steam is supplied to a localized region of the steam shower, the steam is then captured in a tunnel created between two adjacent ridges on the plate on the sides and between a horizontal surface of the profiling plate 90 and the sheet 16 on the top and bottom respectively. The pressurized steam is then only applied to that portion of the sheet constituting the bottom surface of the tunnel into which the steam is supplied.

When the profiling plate 90 is contructed as a separate plate, it is important that the contact between the plate 90 and bottom surface 146 be intimate enough to maintain the temperature of the plate above 212 degrees F. Of course, the ridges 92 may also extend directly from bottom surface 146. The separate plate, however, is generally preferred because it is more easily manufactured.

The foregoing invention has been described with reference to its preferred embodiments. Various alterations and modifications will, however, occur to those skilled in the art. For example, the "sacrificial" steam-flow chamber 58, could be deleted if it is not necessary for the adequate heat-transfer performance of the apparatus in a given application. The "sacrificial" steam-flow chamber 58 could also be sectionally baffled in the profiling embodiment of the invention, in a manner previously described for the Coanda nozzle chamber 22 if it is necessary to insure that the "sacrificial" flow 13 is applied to the process in the region 16 for which the application is intended.

The "steam-shower" apparatus could be constructed of a reduced cross-machine length, in any of the embodiments, to provide an apparatus whose function is to operate over only a reduced percentage of the actual paper-machine width.

Figure 4:
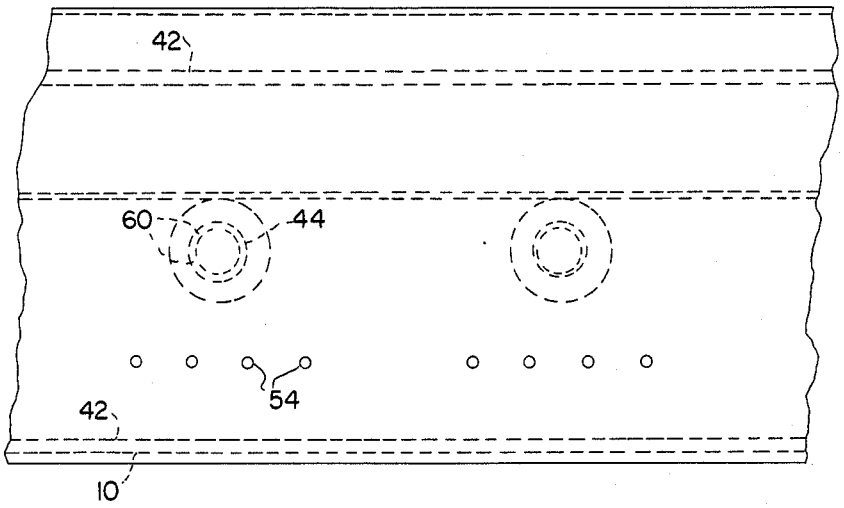
FIG. 4 is a front elevational view of a segment of the steam-shower apparatus shown in FIG. 3.

The "profiling" embodiments of FIGS. 1 and 2 and FIGS. 5–9, and the "non-profiling" embodiment of FIGS. 3 and 4, could be installed in series or physically coupled in series, in the machine direction, in such a way as to provide a design iteration which would provide one shower segment for the purpose of uniform cross-direction steam application, and one shower segment for the purpose of profiling steam application on a positional and volumetric basis. Typically, such an embodiment of the invention would be used to provide both a machine production increase and an independent moisture profiling function, although other applications and purposes are possible, in view of the various uses for steam-showers on a paper-machine.

These and other alterations and modifications are intended to fall within the scope of the appended claims.

What is claimed is:

1. An apparatus for applying a flow of steam to a sheet for the purpose of heating the sheet which runs adjacent a surface of the apparatus, the apparatus comprising:

means for creating a supply of steam and means for housing the supply of steam in said apparatus, said means for housing the supply of steam being located at the lower portion of the apparatus so that a bottom surface of said means for housing the supply of steam is also the bottom surface of the lower portion of the apparatus;

a Coanda nozzle positioned within the apparatus to cause the flow of steam to run between said sheet and the adjacent surface of said apparatus, said flow of steam travelling in a direction opposite to the direction of travel of the sheet;

means to provide steam from said supply to said Coanda nozzle.

2. The apparatus for applying a flow of steam to a sheet of claim 1 further comprising a shield extending from said bottom sheet, said shield having a surface temperature approximately equal to said bottom surface of said apparatus.

3. The apparatus for applying a flow of steam to a sheet of claim 1 wherein said bottom surface of said means for housing a supply of steam is heated to a temperature of greater than 212 degrees Fahrenheit.

4. The apparatus for applying a flow of steam to a sheet of claim 1 wherein said bottom surface of the lower portion of the apparatus is positioned so that an upstream edge of the apparatus is a greater distance from a plane along which a sheet travels through the apparatus than the furthest downstream edge is located from said plane.

5. The apparatus for applying a flow of steam to a sheet of claim 1 further comprising means to divide a space, located between said bottom surface of the apparatus and a plane along which the sheet travels, into compartments extending from said Coanda nozzle to a downstream edge of said apparatus.

6. The apparatus for applying a flow of steam to a sheet of claim 4 further comprising means to divide a space, located between said bottom surface of the apparatus and a plane along which the sheet travels, into compartments extending from said Coanda nozzle to a downstream edge of said apparatus.

7. The apparatus for applying a flow of steam to a sheet of claim 5 wherein said means to divide the space into compartments comprises:

a plurality of ridges extending from the bottom surface of the apparatus to the plane along which the sheet travels so that the ridges contact a sheet travelling through the apparatus.

8. The apparatus for applying a flow of steam to a sheet of claim 6 wherein said means to divide the space into compartments comprises:

a plurality of ridges extending from the bottom surface of the apparatus to the plane along which the sheet travels so that the ridges contact a sheet travelling through the apparatus.

9. The apparatus for applying a flow of steam to a sheet of claim 1 further comprising:

means to control the flow of steam so that steam contact with the sheet is limited to a selected region across the width of the sheet.

10. The apparatus for applying a flow of steam to a sheet of claim 9 wherein said control means comprises:

means for dividing said Coanda nozzle into at least two Coanda nozzles, each of said at least two nozzles including a chamber through which steam passes;

means for providing a flow of steam to each of said at least two Coanda nozzles.

11. The apparatus for applying a flow of steam to a sheet of claim 10 wherein said means for dividing said Coanda nozzle into at least two Coanda nozzles comprises:

semi-circular baffles positioned across the width of the apparatus to surround said means for providing a flow of steam to each of said at least two Coanda nozzles, said baffles preventing carry over of steam from one chamber to any other chamber.

12. The apparatus for applying a flow of steam to a sheet of claim 1 wherein said means to provide steam comprises:

a feed pipe having an orifice communicating with said means for creating a supply of steam, said steam entering said feed pipe through said orifice, said feed pipe also including a second orifice for providing said steam to said Coanda nozzle.

13. The apparatus for applying a flow of steam to a sheet of claim 12 wherein said means to provide steam further comprises:

a selectively actuable stepper-motor;

means for adjustably controlling the percentage of said orifice which is open to said supply of steam, said orifice adjustable control means completely closing siad orifice to prevent the flow of steam through one of said at least two Coanda nozzles and partially closing said orifice to adjust the volume of steam flowing through one of said at least two Coanda nozzles;

coupling means for connecting said stepper motor to said means for adjustably controlling said orifice.

14. The apparatus for applying a flow of steam to a sheet of claim 13 wherein said means for adjustably controlling the percentage of said orifice which is open to said supply of steam is a valve-poppet and the coupling means is a lead-screw coupling connected to a shaft of said stepper-motor.

15. The apparatus for applying a flow of steam to a sheet of claim 1 further comprising a means for creating a positive pressure wall at the edge of said apparatus where the sheet first comes into a position adjacent said apparatus.

16. The apparatus for applying a flow of steam to a sheet of claim 10 further comprising means for creating a secondary flow of steam from said means for providing steam from said supply to said Coanda nozzle, said secondary flow of steam being supplied at a location relative to each of said at least two Coanda nozzles so that said secondary flow is entrained by the steam emitted from each of said at least two Coanda nozzles, said secondary flow of steam providing a second source of steam thereby preventing entrainment of air from the atmosphere external to the apparatus.

17. The apparatus for applying a flow of steam to a sheet of claim 1 further comprising means to collect condensation accumulating on outside walls of said apparatus so that said condensation will not drip on a sheet outside of said apparatus.

18. The apparatus for applying a flow of steam to a sheet for the purpose of heating the sheet which runs along a plane adjacent a surface of the apparatus, the apparatus comprising:

means for creating a supply of steam and means for housing the supply of steam in said apparatus, said means for housing the supply of steam being located at the lower portion of the apparatus so that a bottom surface of said means for housing the supply of steam is also the bottom surface of the lower portion of the apparatus;

a Coanda nozzle positioned within the apparatus to cause a flow of steam to run between said sheet and the adjacent surface of said apparatus, said flow of steam travelling in a direction opposite to the direction of travel of the sheet, said Coanda nozzle being divided into at least two Coanda nozzles, each of said at least two nozzles including a chamber through which steam passes;

means for providing a flow of steam to each of said at least two Coanda nozzles;

means for creating a secondary flow of steam from said means for providing steam from said supply to said Coanda nozzle, said secondary flow of steam being supplied at a location relative to each of said at least two Coanda nozzles so that said secondary flow is entrained by the steam emitted from each of said at least two Coanda nozzles, said secondary flow of steam providing a second source of steam thereby preventing entrainment of air from the atmosphere external to the apparatus.

19. The apparatus for applying a flow of steam to a sheet of claim 18 wherein said bottom surface of said means for housing a supply of steam is heated to a temperature of greater than 212 degrees Fahrenheit.

20. The apparatus for applying a flow of steam to a sheet of claim 18 wherein said bottom surface of the lower portion of the apparatus is positioned so that an upstream edge of the apparatus is a greater distance from a plane along which a sheet travels through the apparatus than the furthest downstream edge is located from said plane.

21. The apparatus for applying a flow of steam to a sheet of claim 18 further comprising means to divide a space, located between said bottom surface of the apparatus and a plane along which the sheet travels, into compartments extending from said Coanda nozzle to a downstream edge of said apparatus.

22. The apparatus for applying a flow of steam to a sheet of claim 20 further comprising means to divide a space, located between said bottom surface of the apparatus and a plane along which the sheet travels, into compartments extending from said Coanda nozzle to a downstream edge of said apparatus.

23. The apparatus for applying a flow of steam to a sheet of claim 21 wherein said means to divide the space into compartments comprises:

a plurality of ridges extending from the bottom surface of the apparatus to the plane along which the sheet travels so that the ridges contact a sheet travelling through the apparatus.

24. The apparatus for applying a flow of steam to a sheet of claim 22 wherein said means to divide the space into compartments comprises:

a plurality of ridges extending from the bottom surface of the apparatus to the plane along which the sheet travels so that the ridges contact a sheet travelling through the apparatus.

25. A method of applying a flow of steam to a sheet for the purpose of heating the sheet, said method comprising the steps of:

creating a supply of steam and housing the steam in a steam supply manifold having a bottom surface adjacent a plane along which the sheet travels and which is heated to a temperature above 212 degrees Fahrenheit;

feeding said steam to a chamber leading to a Coanda nozzle;

running the sheet along a said plane;

directing a flow of steam through said Coanda nozzle, said Coanda nozzle being arranged so that said flow of steam passing through said nozzle travels along a path parallel to said surface of said apparatus adjacent said sheet in a direction opposite the direction of travel of the sheet.

26. The method of applying a flow of steam to a sheet of claim 25 further comprising the steps of:

providing a means for dividing said Coanda nozzle and said chamber leading into said nozzle into several Coanda nozzles and corresponding chambers;

selectively supplying steam through a selected one of said several chambers and corresponding Coanda nozzle.

27. The method of applying a flow of steam to a sheet of claim 25 further comprising the steps of;

creating a secondary flow of steam and supplying said secondary flow to said sheet so that said secondary flow is entrained by said flow of steam from said Coanda nozzle.

28. The method of applying a flow of steam to a sheet of claim 25 further comprising the step of backpressuring the steam in a space between said bottom surface and the sheet.

29. The method of applying a flow of steam to a sheet of claim 28 wherein said step of backpressuring the steam comprises positioning said bottom surface so that an upstream edge of the bottom surface is at a greater distance from said plane along which the sheet travels than the furthest downstream edge is located from said plane.

30. The method of applying a flow of steam to a sheet of claim 25 further comprising the step of providing a plurality of ridges extending from said bottom surface to the plane along which the sheet travels so that the ridges contact a sheet travelling along said plane.

* * * * *